US008481115B2

(12) United States Patent
Tokoro et al.

(10) Patent No.: US 8,481,115 B2
(45) Date of Patent: Jul. 9, 2013

(54) COATED, FINE METAL PARTICLES COMPRISING TITANIUM OXIDE AND SILICON OXIDE COATING, AND THEIR PRODUCTION METHOD

(75) Inventors: Hisato Tokoro, Fukaya (JP); Takashi Nakabayashi, Hitachi (JP); Shigeo Fujii, Kumagaya (JP)

(73) Assignee: Hitachi Metals, Ltd., Tokyo (JP)

( * ) Notice: Subject to any disclaimer, the term of this patent is extended or adjusted under 35 U.S.C. 154(b) by 277 days.

(21) Appl. No.: 12/934,589

(22) PCT Filed: Mar. 26, 2009

(86) PCT No.: PCT/JP2009/056160

§ 371 (c)(1),
(2), (4) Date: Sep. 24, 2010

(87) PCT Pub. No.: WO2009/119757

PCT Pub. Date: Oct. 1, 2009

(65) Prior Publication Data

US 2011/0293940 A1 Dec. 1, 2011

(30) Foreign Application Priority Data

Mar. 27, 2008 (JP) ..... 2008-082668
Dec. 19, 2008 (JP) ..... 2008-323827

(51) Int. Cl.

| | |
|---|---|
| ***B32B 5/16*** | (2006.01) |
| ***B05D 7/00*** | (2006.01) |
| ***B05D 7/14*** | (2006.01) |
| ***B05D 3/10*** | (2006.01) |

(52) U.S. Cl.
USPC ..... 427/214; 427/216; 427/219; 427/419.1; 427/419.2; 427/419.3; 427/403; 427/404

(58) Field of Classification Search
USPC ..... 428/403–407; 427/216, 219, 214, 427/419.1, 419.2, 419.3
See application file for complete search history.

(56) References Cited

U.S. PATENT DOCUMENTS 5,985,466 A * 11/1999 Atarashi et al. ..... 428/570
7,858,184 B2 * 12/2010 Tokoro et al. ..... 428/403
7,892,316 B2 * 2/2011 Kaneko et al. ..... 75/348

(Continued)

FOREIGN PATENT DOCUMENTS

JP 09-143502 6/1997
JP 2000/030920 1/2000

(Continued)

*Primary Examiner* — Hoa (Holly) Le
(74) *Attorney, Agent, or Firm* — Sughrue Mion, PLLC

(57) ABSTRACT

A method for producing coated, fine metal particles each having a Ti oxide coating and a silicon oxide coating formed in this order on a metal core particle by mixing powder comprising TiC and TiN with oxide powder of a metal M meeting the relation of $\Delta G_{M\text{-}O} > \Delta G_{TiO2}$, wherein $\Delta G_{M\text{-}O}$ represents the standard free energy of forming an oxide of the metal M; heat-treating the resultant mixed powder in a non-oxidizing atmosphere to reduce the oxide of the metal M with the powder comprising TiC and TiN, while coating the resultant metal M particles with Ti oxide; coating the Ti-oxide-coated surface with silicon oxide; and classifying the resultant particles such that they have a median diameter d50 of 0.4-0.7 μm, and a variation coefficient (=standard deviation/average particle size) of 35% or less, which indicates a particle size distribution range. Coated, fine metal particles each having a Ti oxide coating and a silicon oxide coating formed in this order on a metal core particle, which has a median diameter d50 of 0.4-0.7 μm, and a variation coefficient (=standard deviation/average particle size) of 35% or less, which indicates a particle size distribution range.

13 Claims, 6 Drawing Sheets

U.S. PATENT DOCUMENTS

| | | | | |
|---|---|---|---|---|
| 2003/0051635 | A1* | 3/2003 | Sankara Subramanian et al. | 106/437 |
| 2005/0191202 | A1* | 9/2005 | Iwasaki et al. | 419/28 |
| 2007/0151417 | A1* | 7/2007 | Kaneko et al. | 75/252 |
| 2007/0281160 | A1* | 12/2007 | Krishna et al. | 428/403 |
| 2009/0057605 | A1* | 3/2009 | Tokoro et al. | 252/62.55 |
| 2010/0047579 | A1* | 2/2010 | Tokoro et al. | 428/403 |
| 2010/0178510 | A1* | 7/2010 | Kaneko et al. | 428/403 |
| 2011/0159181 | A1* | 6/2011 | Kaneko et al. | 427/214 |

FOREIGN PATENT DOCUMENTS

| | | | |
|---|---|---|---|
| JP | 2005-120470 | A | 5/2005 |
| JP | 2007-224323 | A | 9/2007 |
| WO | 2007/148734 | A1 | 12/2007 |
| WO | 2008/035681 | A1 | 3/2008 |

* cited by examiner

COATED, FINE METAL PARTICLES COMPRISING TITANIUM OXIDE AND SILICON OXIDE COATING, AND THEIR PRODUCTION METHOD

FIELD OF THE INVENTION

The present invention relates to coated, fine metal particles used for magnetic recording media such as magnetic tapes and magnetic recording discs, electromagnetic wave absorbers, electronic devices (soft magnetic bodies such as yokes) for inductors and printed circuit boards, photocatalysts, nucleic-acid-extracting magnetic beads, medical microspheres, etc., and their production method.

BACKGROUND OF THE INVENTION

As electronic apparatuses and devices have higher performance and smaller sizes and weight, their materials are required to have higher performance and smaller particle sizes. For instance, magnetic particles for magnetic tapes are required to have smaller sizes and improved magnetization to enhance magnetic recording densities.

Also, to separate and collect proteins such as antigens, etc. for the diagnosis of sickness such as allergy, etc., magnetic separation methods have become widely used. As a result, increasingly higher demand is mounting to provide fine magnetic beads having high magnetization and excellent corrosion resistance.

Fine magnetic particles are mainly produced by liquid-phase synthesis methods such as a coprecipitation method, a hydrothermal synthesis method, etc. Fine magnetic particles obtained by the liquid-phase synthesis methods are oxide particles such as ferrite, magnetite, etc. A method of utilizing the thermal decomposition of an organometallic compound has recently become used; and fine magnetic Fe particles are formed, for instance, from $Fe(CO)_6$.

Because magnetic metal particles have larger magnetization than that of oxide particles such as ferrite, their use for industrial applications is greatly expected. For instance, because the metal Fe has saturation magnetization of 218 $Am^2/kg$, much larger than that of iron oxide, it is advantageous in providing excellent magnetic field response and large signal intensity. However, fine metal Fe particles are easily oxidized. When the fine metal Fe particles have a particle size of 100 μm or less, particularly 1 μm or less, they are vigorously burned in the air because of the increased specific surface area, resulting in difficulty in handling in a dry state. Accordingly, oxide particles such as ferrite, magnetite, etc. are widely used.

When the dried fine metal particles are handled, it is necessary to coat the particles lest that the metal is exposed to the air (oxygen). However, the metal would be oxidized considerably even by the method of JP 2000-30920 A, by which the particles are coated with an oxide of the particle-forming metal.

JP 9-143502 A proposes a method for producing graphite-coated, fine metal particles by mixing carbonaceous particles such as carbon black, natural graphite, etc. with particles of a metal or its compound (selected from metal oxides, metal carbides and metal salts), heat-treating the resultant mixture at 1600-2800° C. in an inert gas atmosphere, and cooling it at a speed of 45° C./minute or less. However, because metal-containing particles are heat-treated at an extremely high temperature of 1600-2800° C., this method may suffer the sintering of fine metal particles, and the production efficiency is low. Also, because graphite has a structure in which graphene sheets are laminated, its coatings on spherical, fine metal particles inevitably have lattice defects. Accordingly, it is unsatisfactory for applications needing high corrosion resistance, such as magnetic beads, etc. Thus desired are fine metal particles having high corrosion resistance, and a low-cost method for producing such fine metal particles with excellent industrial productivity.

OBJECT OF THE INVENTION

Accordingly, an object of the present invention is to provide coated, fine metal particles having excellent corrosion resistance and high magnetization, and their production method.

DISCLOSURE OF THE INVENTION

As a result of intensive research in view of the above object, the inventors have found that when powder comprising TiC and TiN and powder of metal oxide having higher standard free energy of formation than that of $TiO_2$ are mixed and heat-treated, metal particles coated with Ti oxide are obtained, and that the coating of the Ti-oxide-coated metal particles with silicon oxide and their classification provide magnetic silica particles with excellent dispersion stability. The present invention has been completed based on such finding.

Thus, the method of the present invention for producing coated, fine metal particles each having a Ti oxide coating and a silicon oxide coating formed in this order on a metal core particle comprises the steps of mixing powder comprising TiC and TiN with oxide powder of a metal M meeting the relation of $\Delta G_{M\text{-}O} > \Delta G_{TiO2}$, wherein $\Delta G_{M\text{-}O}$ represents the standard free energy of forming an oxide of the metal M; heat-treating the resultant mixed powder in a non-oxidizing atmosphere to reduce the oxide of the metal M with the powder comprising TiC and TiN, while coating the resultant metal M particles with Ti oxide; coating the Ti-oxide-coated surface with silicon oxide; and classifying the resultant particles such that they have a median diameter d50 of 0.4-0.7 μm, and a variation coefficient (=standard deviation/average particle size) of 35% or less, which indicates a particle size distribution range.

The classification is conducted preferably by a magnetic separation method, a decantation method, a filtration method, a centrifugal separation method, or a combination thereof.

The powder comprising TiC and TiN preferably contains 10-50% by mass of TiN. The TiN content is defined by the following formula (1):

$$\text{TiN content (\% by mass)} = [\text{TiN (\% by mass)}]/[\text{TiC (\% by mass)} + \text{TiN (\% by mass)}] \quad (1).$$

The Ti oxide is preferably based on $TiO_2$. The $TiO_2$-based Ti oxide coating layer has high crystallinity, and sufficiently protects fine metal core particles. The term "based on $TiO_2$" means that among the measured X-ray diffraction peaks of Ti oxide including other titanium oxides than $TiO_2$ (for instance, $Ti_nO_{2n-1}$ having a nonstoichiometric composition), the peak of $TiO_2$ has the maximum intensity. From the aspect of uniformity, it is preferable that the Ti oxide is substantially $TiO_2$. The term "substantially $TiO_2$" means that the percentage of $TiO_2$ is so high that the peaks of other Ti oxides than $TiO_2$ are not clearly discernible in the X-ray diffraction pattern. Accordingly, even if the X-ray diffraction pattern contains peaks of other Ti oxides than $TiO_2$ to such an extent as noise, the condition of "substantially $TiO_2$" is met.

The metal M is preferably a magnetic metal comprising at least one element selected from the group consisting of Fe, Co and Ni, particularly Fe. Because Ti is smaller than Fe in the standard energy of oxide formation, Ti can efficiently and surely reduce Fe oxide. Accordingly, fine, magnetic metal particles having high saturation magnetization and excellent corrosion resistance are obtained. Magnetic beads with magnetic metal cores can be used for magnetic separation.

The oxide of a metal M is preferably $Fe_2O_3$. To obtain coated, fine metal particles having reduced coercivity and increased dispersibility, the ratio of the powder comprising TiC and TiN to the sum of the oxide powder of the metal M and the powder comprising TiC and TiN is preferably 30-50% by mass.

The heat treatment is conducted preferably at 650-900° C.

The coated, fine metal particles of the present invention each having a Ti oxide coating and a silicon oxide coating formed in this order on a metal core particle have a median diameter d50 of 0.4-0.7 μm, and a variation coefficient (=standard deviation/average particle size) of 35% or less, which indicates a particle size distribution range.

With the silicon oxide coating, the coated, fine metal particles exhibit properties as a nucleic-acid-extracting carrier. They also exhibit high corrosion resistance in a fixing treatment with acids or bases, suitable for fixing antibodies, etc.

With the median diameter d50 exceeding 0.7 μm, the sedimentation of the particles in a solution is undesirably fast. With the median diameter of less than 0.4 μm, each particle has too low magnetization, resulting in low efficiency in magnetic separation, etc. When the variation coefficient exceeds 35%, the above problems occur because the percentage of particles outside the particle size range of 0.4-0.7 μm increases. The variation coefficient of 35% or less provides magnetic beads with high antigen-detecting sensitivity in immunoassay. The variation coefficient is preferably 30% or less.

The coated, fine metal particles of the present invention preferably contain 0.2-1.4% by mass of carbon and 0.01-0.2% by mass of nitrogen, more preferably 0.2-1.1% by mass of carbon and 0.04-0.12% by mass of nitrogen. The total amount of carbon and nitrogen is preferably 0.24-0.6% by mass, more preferably 0.25-0.55% by mass to obtain high magnetization.

The coated, fine metal particles preferably have saturation magnetization of 80 $Am^2/kg$ or more. The saturation magnetization of 80 $Am^2/kg$ or more cannot be obtained by magnetic oxides such as magnetite, etc. The saturation magnetization is preferably 180 $Am^2/kg$ or less. The coated, fine metal particles having saturation magnetization in a range of 80-180 $Am^2/kg$ have excellent corrosion resistance and magnetic properties because of a good quantity balance between the coating layer and the magnetic body (magnetic core). Such high saturation magnetization provides the coated, fine metal particles with extremely improved magnetic collection efficiency. The saturation magnetization is more preferably 95-180 $Am^2/kg$, most preferably 100-180 $Am^2/kg$.

The coated, fine metal particles preferably have coercivity of 8 kA/m or less. The coated, fine metal particles having such coercivity have extremely small residual magnetization, resulting in extremely little magnetic aggregation and excellent dispersibility. The more preferred coercivity is 4 kA/m or less.

When the absorbency of a uniform dispersion of the coated, fine metal particles in a PBS buffer is measured in a still state, a decreasing speed of the absorbency is preferably 0.01-0.03% per one second. With a slow sedimentation speed of the coated, fine metal particles, target materials in a solution can be sufficiently collected. When the absorbency-decreasing speed is less than 0.01% per one second, the particles move too small distances in a solution, resulting in difficulty in collecting materials distant from a magnet, meaning low efficiency.

In the X-ray diffraction pattern of the coated, fine metal particles, the half width of the maximum peak of $TiO_2$ is 0.3° or less, and the intensity ratio of the maximum peak of $TiO_2$ to the maximum peak of the metal M is preferably 0.03 or more. The maximum peak intensity ratio is more preferably 0.05 or more.

By the quantitative analysis of 0, Ti and Fe in the X-ray photoelectron spectroscopy of the coated, fine metal particles of the present invention, the Fe content is preferably 14-20 atomic %, and the ratio of the metal Fe component to the entire Fe is 7-11%. The inclusion of Fe provides high saturation magnetization.

When 25 mg of the coated, fine metal particles of the present invention are immersed in 1 mL of an aqueous solution of guanidine hydrochloride having a concentration of 6 M at 25° C. for 24 hours, the amount of Fe ions eluted is preferably 50 mg/L or less. The coated, fine metal particles exhibiting high corrosion resistance even at a high chaotropic salt concentration are suitable for DNA extraction, etc.

The coated, fine metal particles of the present invention are preferably treated with alkali.

The coated, fine metal particles are preferably used for the detection of antigens in immunoassay.

At least one selected from the group consisting of an amino group, a carboxyl group, an aldehyde group, a thiol group, a tosyl group and a hydroxyl group is preferably fixed onto the coated, fine metal particles of the present invention. This facilitates the fixing of various materials.

A ligand is preferably fixed onto the coated, fine metal particles of the present invention. Using the specific reaction of a ligand, an objective material can be collected.

The coated, fine metal particles of the present invention are preferably further coated with a blocking agent. The blocking agent suppresses nonspecific adsorption. Surface portions of the coated, fine metal particles, onto which an amino group, a ligand, etc. are not fixed, are preferably coated with the blocking agent.

DESCRIPTION OF THE BEST MODE OF THE INVENTION

Figure 1:
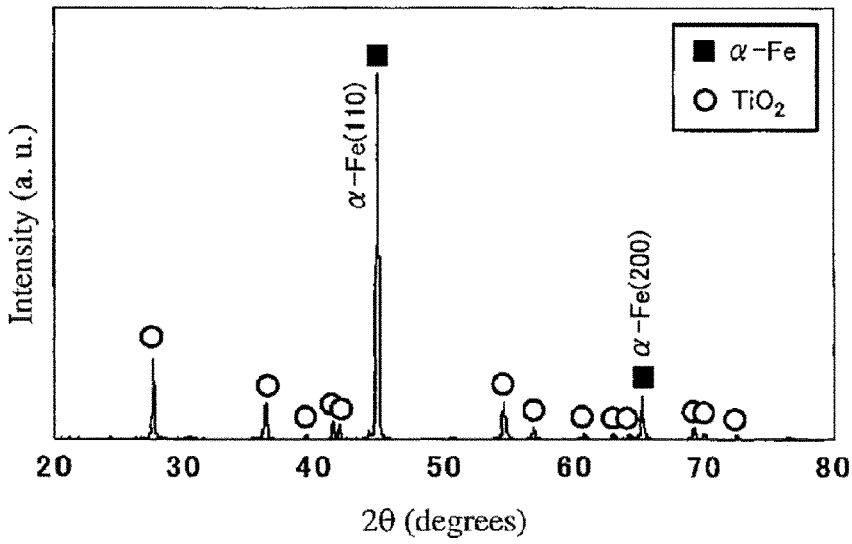
FIG. 1 is a graph showing the X-ray diffraction pattern of the powder sample of Reference Example 1.

[1] Production Method of Coated, Fine Metal Particles

The coated, fine metal particles each having a Ti oxide coating and a silicon oxide coating formed in this order on a metal core particle are produced by coating Ti-oxide-coated, fine metal particles with silicon oxide. The resultant silica-coated, fine metal particles, which may be called "magnetic silica particles," are classified to obtain silica-coated, fine metal particles having a median diameter d50 of 0.4-0.7 μm and a variation coefficient (=standard deviation/average particle size) of 35% or less, which indicates a particle size distribution range.

(1) Production of Ti-Coated, Fine Metal Particles

The Ti-coated, fine metal particles are produced by mixing oxide powder of a metal M meeting the relation of $\Delta G_{M\text{-}O}>\Delta G_{TiO2}$, wherein $\Delta G_{M\text{-}O}$ represents the standard free energy of forming an oxide of the metal M, with powder comprising TiC and TiN, and heat-treating the resultant mixed powder in a non-oxidizing atmosphere to reduce the oxide of the metal M with TiC and TiN, while coating the resultant metal M particles with Ti oxide based on $TiO_2$.

(i) Oxide Powder of Metal M

The particle size of the oxide powder of a metal M may be properly selected depending on the target particle sizes of the coated, fine metal particles, but it is preferably in a range of 0.001 μm to 5 μm. When the particle size is less than 0.001 μm, secondary aggregation occurs extremely, making it difficult to handle them in the subsequent production steps. When the particle size is more than 5 μm, the metal oxide powder has too small specific surface area, resulting in a slow reduction reaction. The practical particle size of the metal oxide powder is 0.005-1 μm. The metal M is selected from transition metals, precious metals and rare earth metals. As magnetic materials, Fe, Co, Ni and alloys thereof are preferable, and their oxides include $Fe_2O_3$, $Fe_3O_4$, CoO, $CO_3O_4$, NiO, etc. Fe is particularly preferable because of high saturation magnetization, and its oxide is preferably $Fe_2O_3$ because of low cost. Because Ti is lower than Fe in the standard energy of oxide formation, Ti can efficiently and surely reduce Fe oxide.

When the standard free energy of formation ($\Delta G_{M\text{-}O}$) of an oxide of a metal M meets the relation of $\Delta G_{M\text{-}O}>\Delta G_{TiO2}$, the oxide of a metal M can be reduced by powder comprising TiC and TiN. $\Delta G_{M\text{-}O}$ is the standard energy of forming an oxide of the metal M, and $\Delta G_{TiO2}$ (=−889 kJ/mol) is the standard energy of forming Ti oxide. For instance, because $Fe_2O_3$ ($\Delta G_{Fe2O3}$=−740 kJ/mol) meets the relation of $\Delta G_{Fe2O3}>\Delta G_{TiO2}$, it is reduced by the powder comprising TiC and TiN. When a $TiO_2$ coating is formed by reduction, the specific gravity of the coated, fine metal particles decreases. Because $TiO_2$ has high hydrophilicity, the $TiO_2$-coated, fine metal particles are suitably dispersed in a solution (water, etc.), for instance, as magnetic beads.

(ii) Powder Comprising TiC and TiN

The powder comprising TiC and TiN is used to reduce a metal M oxide, forming Ti-oxide-coated, fine particles of metal M, in which the amounts of other phases than M and $TiO_2$ are reduced. The amount of residual C is reduced by using both TiN and TiC.

To conduct a reduction reaction efficiently, the powder comprising TiC and TiN preferably has a particle size of 0.01-20 μm. With the particle size of less than 0.01 μm, it is difficult to handle the powder because it is easily oxidized in the air. When the particle size is more than 20 μm, the reduction reaction does not proceed easily because of a small specific surface area. To conduct the reduction reaction sufficiently while suppressing oxidation in the air, the particle size is particularly 0.1-5 μm.

(iii) Reduction Reaction

The ratio of the powder comprising TiC and TiN to the M oxide powder is preferably at least a stoichiometric ratio of the reduction reaction. If Ti lacks, the M oxide powder would become bulky by sintering during heat treatment.

When both TiC and TiN are used, the TiN content is preferably 10-50% by mass. The TiN content is expressed by the formula (1): TiN content (% by mass)=[TiN (% by mass)]/[TiC (% by mass)+TiN (% by mass)]. When the TiN content is less than 10% by mass, the element C is not fully reduced. The TiN content exceeding 50% by mass results in the lack of C, causing insufficient reduction of the oxide to the metal M, thus failing to obtain completely coated, fine metal particles. The mixing of the M oxide powder and the powder comprising TiC and TiN is conducted by a stirring machine such as a mortar, a stirrer, a V mixer, a ball mill, a vibration mill, etc.

When the mixed powder of the M oxide powder and the powder comprising TiC and TiN is heat-treated in a non-oxidizing atmosphere, an oxidation reduction reaction occurs between the M oxide powder and the powder comprising TiC and TiN, forming metal M particles coated with $TiO_2$-based Ti oxide. The heat treatment atmosphere is preferably a non-oxidizing atmosphere, which may be an inert gas such as Ar and He, a gas such as $N_2$, $CO_2$, $NH_3$, etc., though not restrictive. The heat treatment temperature is preferably 650-900° C. When it is lower than 650° C., the reduction reaction does not sufficiently proceed. When it is higher than 900° C., $Ti_nO_{2n-1}$ having a nonstoichiometric composition is formed. $Ti_nO_{2n-1}$ is formed by the removal of oxygen by the metal M from $TiO_2$ at higher than 900° C., or by the release of oxygen by $TiO_2$ into the non-oxidizing atmosphere. As a result, the oxide of the metal M is insufficiently reduced, or an insufficient coating is formed. When the heat treatment temperature is 650-900° C., a highly uniform coating substantially based on $TiO_2$ and having less defects is formed. The $TiO_2$ coating is suitable for coated, fine metal particles for a photocatalyst.

(iv) Magnetic Separation

Because the coated, fine, magnetic metal particles may contain non-magnetic components (particles made only of $TiO_2$-based Ti oxide), a magnetic separation operation is preferably conducted plural times with a permanent magnet, if necessary, to collect only magnetic particles.

(2) Production of Silica-Coated, Fine Metal Particles

The Ti-coated, fine metal particles are further coated with silica to form silica-coated, fine metal particles. The Ti-coated, fine metal particles dispersed in alcohol solvent (methanol, ethanol, n-propanol, i-propanol, butanol, etc.) are mixed with alkoxysilane (tetramethoxysilane, tetraethoxysilane, tetrapropoxysilane, tetrabutoxysilane, diethoxydimethoxysilane, aminopropyltrimethoxysilane, etc.), and subject to hydrolysis and polycondensation in the presence of a basic catalyst (ammonia, amines, NaOH or KOH) to coat Ti surfaces of the coated, fine metal particles with silica. The magnetic separation operations of the resultant silica-coated, fine metal particles are preferably conducted plural times with a permanent magnet, if necessary, to collect magnetic particles only.

Alkoxysilane may be mixed with other metal alkoxides (aluminum isopropoxide, etc.). The amount of metal alkoxide added is preferably 10% by mass or less based on alkoxysilane. With the metal alkoxide added, silicon oxide is bonded to metal oxide to form a dense structure.

(3) Classification of Silica-Coated, Fine Metal Particles

The silica-coated, fine metal particles are classified by a magnetic separation method, a decantation method, a filtration method, a centrifugal separation method, or a combination thereof, such that their median diameter d50 was 0.4-0.7 μm, and that their variation coefficient (=standard deviation/average particle size, indicating a particle size distribution range) is 35% or less. In the classification, aggregation is preferably removed in advance. Before the classification, a dispersion treatment is preferably conducted. The dispersion treatment includes a mechanical disintegration treatment, an ultrasonic-irradiating dispersion treatment, a dispersion treatment using pressure difference, etc.

[2] Structure and Properties of Coated, Fine Metal Particles (1) Particle Size and Particle Size Distribution of Coated, Fine Metal Particles The coated, fine metal particles obtained by the above method have particle sizes variable depending on the particle sizes of the M oxide powder. To obtain high corrosion resistance and dispersibility, the median diameter d50 of the coated, fine metal particles is 0.4-0.7 μm. When the median diameter is less than 0.4 μm, the coated, fine metal particles do not have sufficiently thick coatings, resulting in low corrosion resistance, and extremely small magnetization per one particle, which leads to slow magnetic response. When the median diameter d50 is more than 0.7 μm, the coated, fine metal particles have low dispersibility, resulting in difficult handling in a liquid because of fast sedimentation.

The variation coefficient indicating a particle size distribution range of the coated, fine metal particles is preferably 35% or less. When the variation coefficient exceeds 35%, the percentage of particles outside the particle size range of 0.4-0.7 μm increases, resulting in decrease in corrosion resistance, magnetic response, dispersibility, etc. With the variation coefficient of 35% or less, there is small unevenness of magnetization per one particle, resulting in good magnetic collection of particles dispersed in a solution.

The median diameter d50 and the variation coefficient can be measured by a laser-diffraction, wet-type, particle size meter. The median diameter d50 is a 50-%-cumulative particle size in a cumulative distribution curve obtained from the particle size distribution (by volume). The variation coefficient is a ratio of the standard deviation of particle size distribution to an average particle size, which is expressed by variation coefficient (%)=[(standard deviation/average particle size)×100], wherein the average particle size is an arithmetic average particle size on a volume basis.

(2) Coating Structure

The coated, fine metal particles have a triple structure having a Ti oxide coating layer and a silicon-oxide-based coating layer, which may be called "silicon oxide coating layer," formed in this order on each metal M particle. The metal M particle and the Ti oxide coating need not have a 1-to-1 core-shell structure, but may have a structure in which two or more metal M particles are dispersed in the Ti oxide layer based on $TiO_2$. The inclusion of two or more metal M particles in the Ti oxide is preferable because a high-content metal M is surely coated. In the method of the present invention, the reduction of the M oxide forms fine metal M particles and Ti oxide coatings simultaneously, there is no metal M oxide layer between the fine metal M particle and the Ti oxide coating. The Ti oxide coatings obtained by a heat treatment at 650° C. or higher have high crystallinity, and higher corrosion resistance than that of amorphous or low-crystallinity Ti oxide coatings formed by a sol-gel method, etc. The coated, fine metal particles of the present invention each having a $TiO_2$-based coating have less coating defects, thus higher in corrosion resistance than those having a $Ti_nO_{2n-1}$ coating having a nonstoichiometric composition.

The silicon oxide coating layer formed on the Ti oxide coating layer provide the particles with properties as carriers for extracting nucleic acids or capturing antigens. The silicon oxide coating layer can be formed by the hydrolysis and polycondensation of alkoxysilane with or without metal alkoxide.

(3) Coating Thickness

The Ti oxide coating based on $TiO_2$ is preferably as thick as 1-1000 nm. When the thickness is less than 1 nm, the coated, fine metal particles do not have sufficient corrosion resistance. When the thickness is more than 1000 nm, the coated, fine metal particles are too large, having low dispersibility in a liquid, and having low saturation magnetization for fine, magnetic metal particles. The Ti oxide coating is more preferably as thick as 5-300 nm. The thickness of the silicon oxide coating is preferably 5-500 nm, more preferably 5-100 nm. The coating thickness is determined from the transmission electron photomicrograph (TEM photograph) of the coated, fine metal particles. When the coating has uneven thickness, an average of the maximum thickness and the minimum thickness is regarded as the coating thickness. The fine metal particles may not be coated completely with $TiO_2$-based Ti oxide and silicon oxide, but may be partially exposed to the surface, though complete coating is preferable.

(4) Crystallinity of Ti Oxide

In the X-ray diffraction pattern of the coated, fine metal particles, when the half width of the maximum peak of $TiO_2$ is 0.3° or less, and when the intensity ratio of the maximum peak of $TiO_2$ to the maximum peak of the metal M is 0.03 or more, the Ti oxide has such high crystallinity that the coated, fine metal particles are corrosion-resistive. When $TiO_2$ is amorphous or low-crystallinity, diffraction peaks are not observed or broad. Accordingly, the maximum peak intensity ratio is small with a large half width. The maximum peak intensity ratio is more preferably 0.05 or more. A higher maximum peak intensity ratio (higher coating ratio) provides lower saturation magnetization. Thus, the maximum peak intensity ratio is preferably 3 or less.

(5) Functions as Magnetic Particles

When the metal M is a magnetic metal Fe, the coated, fine metal particles obtained by the above method have saturation magnetization in a range of 50-180 $Am^2/kg$, functioning as magnetic particles. This corresponds to a case where a ratio of Ti to (Fe+Ti) is 11-67% by mass when the coated, fine metal particles are composed of a magnetic metal Fe and $TiO_2$.

When the saturation magnetization of the magnetic particles is as small as less than 50 $Am^2/kg$, they have slow response to a magnetic field. When the saturation magnetization is more than 180 $Am^2/kg$, the ratios of Ti oxide and silicon oxide are small, and the metal Fe particles are not fully coated with Ti oxide and silicon oxide, resulting in low corrosion resistance and easily deteriorated magnetic properties. To obtain high saturation magnetization and sufficient corrosion resistance simultaneously, the coated, fine metal particles preferably have saturation magnetization of 180 $Am^2/kg$ or less. To have excellent recovery efficiency and magnetic separation performance when used as magnetic beads, etc., the coated, fine metal particles more preferably have saturation magnetization of 95-180 $Am^2/kg$. Saturation magnetization in this range cannot be achieved, when magnetite ($Fe_3O_4$) particles having as small saturation magnetization as about 92 $Am^2/kg$ are used as magnetic beads, etc. With saturation magnetization in this range, the particles have sufficient response to a magnetic field in magnetically collecting target materials, which are collected onto the particle surfaces. From the aspect of dispersibility, the coercivity of the coated, fine metal particles is preferably 15 kA/m or less, more preferably 8 kA/m (100 Oe) or less, most preferably 4 kA/m or less. Although thick $TiO_2$ coatings would provide high dispersibility even with large coercivity, they would reduce the saturation magnetization of the coated, fine metal particles. When the coercivity is more than 8 kA/m, magnetic particles are magnetically aggregated without a magnetic field, resulting in low dispersibility in a liquid.

(6) Concentration of Elements Contained

The coated, fine metal particles preferably contain 0.2-1.4% by mass of C. C is mainly a residue of excess TiC powder used as a starting material. In the method of the present invention for reducing the metal M oxide with Ti as a reducing agent to a metal M, C in TiC also functions as a reducing agent, auxiliarily reducing the metal M oxide. Less than 0.2% by mass of C is not preferable because the M oxide is not fully reduced. More than 1.4% by mass of C leads to the reduced metal content, and low saturation magnetization when the metal is mostly at least one element selected from the group consisting of Fe, Co and Ni. The remaining C makes the coated, fine metal particles hydrophobic, resulting in low dispersibility in an aqueous solution, which is particularly unpreferable as magnetic beads, etc. The C content is more preferably 0.2-1.1% by mass.

The coated, fine metal particles preferably contain 0.01-0.2% by mass of N. N is derived from the nitriding of excess Ti during a heat treatment, and the residue of the TiN powder used as a starting material after the heat treatment. Less than 0.01% by mass of N is not preferable because the reduction effect of TiN is not obtained. More than 0.2% by mass of N undesirably leads to increase in non-magnetic titanium nitride and low saturation magnetization. To sufficiently coat fine metal M core particles, it is preferable that Ti exists excessively to some extent, such that part of Ti is nitrided during the heat treatment. The N content is more preferably 0.04-0.2% by mass.

To keep higher saturation magnetization, it is important to control the total amount of C and N contained in the coated, fine metal particles in a predetermined range; the total amount (C+N) of C and N contained is preferably 0.24-1.6% by mass, more preferably 0.24-0.60% by mass. When (C+N) is less than 0.24% by mass, the contents of C and N are outside above preferred ranges. (C+N) exceeding 1.6% by mass invites the reduction of saturation magnetization. To provide sufficient coating to fine metal M particles while achieving high saturation magnetization, (C+N) is particularly 0.60% or less by mass.

The C content in the above coated, fine metal particles is measured by high-frequency-heated infrared absorption, and the N content is measured by a thermal conduction method with heating in an inert gas or a Kjeldahl method.

(7) Corrosion Resistance

When 25 mg of coated, fine metal particles, in which the metal M is Fe, are immersed in 1 mL of an aqueous solution of guanidine hydrochloride having a molar concentration of 6 M at 25° C. for 24 hours, the amount of Fe ions eluted is preferably 50 mg/L or less. Because coated, fine metal particles with such amount of Fe ions eluted have high corrosion resistance even at a high concentration of a chaotropic salt, they are suitable for DNA extraction, etc. needing a treatment in an aqueous chaotropic salt solution. Although such corrosion resistance that the amount of Fe ions eluted is 50 mg/L or less can be obtained without an alkali treatment, the alkali treatment is preferable to surely obtain the above corrosion resistance level. As is clear from the descriptions concerning "corrosion resistance" and "X-ray diffraction" in the specification, the coated, fine metal particles of the present invention include assembly (powder) of coated, fine metal particles.

(8) Surfaces of Coated, Fine Metal Particles

The coated, fine metal particles preferably have at least one of an amino group, a carboxyl group, an aldehyde group, a thiol group, a tosyl group, and a hydroxyl group fixed onto the surfaces. With these functional groups fixed onto the surfaces, various ligands can be easily fixed. The functional groups can also adjust dispersibility in a solution.

A ligand is preferably fixed to the surfaces of the coated, fine metal particles. The ligand is a substance specifically bonding to a particular substance. The ligand may be avidin, biotin, streptavidin, secondary antibodies, protein G, protein A, protein A/G, protein L, antibodies, antigens, lectins, sugar chains, hormones, nucleic acids, etc. These materials may be fixed alone or in combination. With avidin or streptavidin fixed to the surfaces of the coated, fine metal particles, the coated, fine metal particles can specifically bond to biotin-labeled materials, such as biotin-labeled antibodies, biotin-labeled DNAs and biotin-labeled fluorescent materials. Because avidin and streptavidin have four bonding sites to biotin, avidin or streptavidin can bond to the biotin-fixed, coated, fine metal particles, and further to a biotin-labeled material. Because the secondary antibody selectively bonds to a particular antibody, it can fix a primary antibody. Because the protein G strongly bonds to Fc of immunoglobulin G (IgG), it can selectively bond to IgG. The protein A exhibits largely different bonding to various types of IgG, selectively bonding to particular IgG. Because the bonding of the protein A to IgG depends on pH, the once-collected IgG can be dissociated by changing pH. Accordingly, the protein-A-fixed, coated, fine metal particles are suitable for the purification of IgG, etc. The protein A/G is a fusion protein of the protein A and the protein G suitable as a ligand. Because the protein L bonds to other Ig than those of cow, goat, sheep and hen, it can selectively collect other Ig than those of cow, goat, sheep and hen in serum containing Ig of cow, goat, sheep or hen. The antibody and the antigen selectively bond to each other by an antigen-antibody reaction. The coated, fine metal particles, to which antibody or antigen is fixed, are suitable for an immunological measurement method (immunoassay). Because the antibodies, antigens, lectins, sugar chains and hormones can specifically collect particular materials, they are suitable for the collection of proteins, cells, etc. For instance, with a desired nucleic acid or a nucleic acid complimentary to part of the desired nucleic acid fixed to the coated, fine metal particles, the desired nucleic acid can be selectively collected.

The coated, fine metal particles are preferably coated with a blocking agent to suppress nonspecific adsorption. The nonspecific adsorption (nonspecificity) is the adsorption of other materials than those desired. The blocking agents include bovine serum albumin (BSA), skim milk, etc. Commercially available blocking agents can be used, for instance, Block Ace (Snow Brand Milk Products Co., Ltd.), etc. for suppressing nonspecific adsorption.

(9) Sedimentability of Particles

When used as carriers for extracting nucleic acids or capturing antigens, the sedimentation speed of the coated, fine metal particles in a solution is preferably low. The sedimentation speed is determined by measuring the absorbency of a uniform dispersion of the coated, fine metal particles in a PBS buffer in a still state, expressed by the decrease ratio (%) of absorbency per one second. To collect a target material by sufficient reaction with the particles, the sedimentation speed (decrease ratio of absorbency per one second) is preferably 0.01-0.03%. When the sedimentation speed exceeds 0.03%, the sedimentation of the particles is too quick, resulting in insufficient reaction between the particles and the target material. When the sedimentation speed is less than 0.01%, the particles move too small distance in a solution, so that the target material in a solution cannot be uniformly collected.

The coated, fine metal particles meeting the above requirements are particularly highly reactive to target materials in a solution, capable of detecting the target materials at high sensitivity. Accordingly, they are suitable as magnetic beads for immunoassay.

The present invention will be explained in more detail referring to Examples below without intention of restricting it thereto.

Reference Example 1

$\alpha$-$Fe_2O_3$ powder having a median diameter of 0.03 μm and TiC powder having a median diameter of 1 μm were mixed at a mass ratio of 7:3 for 10 hours by a ball mill, and the mixed powder was heat-treated at 700° C. for 2 hours in a nitrogen gas in an alumina boat. The X-ray diffraction pattern of the resultant powder sample is shown in FIG. 1. In FIG. 1, the axis of abscissas represents a diffraction angle 2θ(°), and the axis of ordinates represents diffraction intensity (relative value). Analysis with software "Jade, Ver. 5" available from MDI revealed that it had diffraction peaks assigned to $\alpha$-Fe and rutile $TiO_2$.

Calculation from the half width of a (200) peak of $\alpha$-Fe using a Scherrer's equation revealed that Fe had an average crystallite size of 90 nm. The maximum diffraction peak of $TiO_2$ obtained at 2θ=27.5° had a half width of 0.14, and an intensity ratio of the maximum diffraction peak of $TiO_2$ to the maximum diffraction peak [(110) peak] of $\alpha$-Fe was 0.18. This verifies that $TiO_2$ had high crystallinity. Measurement by a laser-diffraction particle size distribution meter ("LA-920" available from HORIBA) revealed that this powder sample had a median diameter d50 of 3.1 μm.

Figure 2:
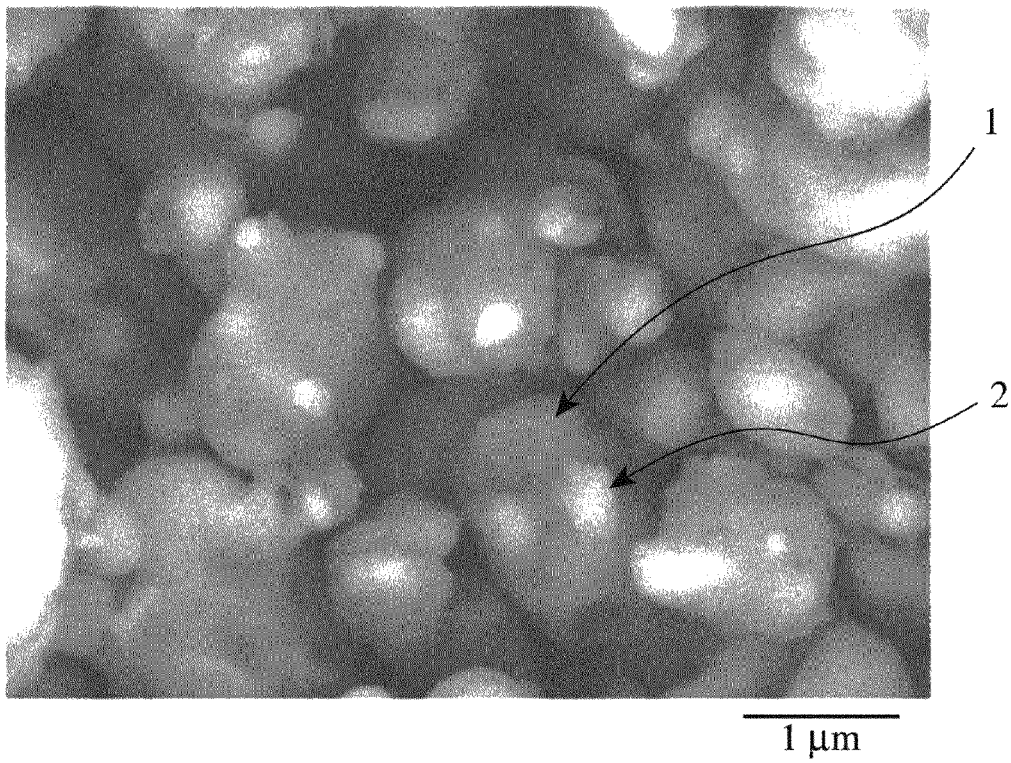
FIG. 2 is a scanning electron photomicrograph of the powder sample of Reference Example 1.

It is clear from the SEM photograph shown in FIG. 2 that the coated, fine metal particles had diameters of several μm. In most coated, fine metal particles, pluralities of Fe particles 2 were coated with a $TiO_2$ layer 1 to form one fine particle. For instance, Fe particles 2 (white portions in FIG. 2) contained in the $TiO_2$ layer shown by the arrow 1 had diameters of about 0.5 μm.

Because Fe oxide has a standard energy of formation $\Delta G_{Fe2O3}$ of −740 kJ/mol, and Ti oxide has $\Delta G_{TiO2}$ of −889 kJ/mol, the latter is smaller than the former. It is thus considered that $\alpha$-$Fe_2O_3$ was reduced by TiC to form $TiO_2$.

5 g of the resultant powder sample and 50 mL of isopropyl alcohol (IPA) were charged into a 100-mL beaker, and subject to ultrasonic irradiation for 10 minutes. With a permanent magnet in contact with an outer surface of the beaker for 1 minute, only magnetic particles were adsorbed to an inner surface of the beaker, and dark gray supernatant liquid was removed. This magnetic separation operation was repeated 50 times, and the purified magnetic particles were dried at room temperature. The magnetic properties of the magnetic particles were measured by VSM (vibrating sample magnetometer) in a maximum magnetic field of 1.6 MA/m. After it was confirmed from their X-ray diffraction pattern that the coated, fine metal particles were constituted by Fe and $TiO_2$, an Fe/Ti mass ratio in the purified magnetic particles was calculated from the measured value of saturation magnetization of the coated, fine metal particles. The results are shown in Table 1.

Reference Examples 2-5

Powder samples were produced and purified to obtain magnetic particles in the same manner as in Reference Example 1, except for changing the mass ratio of $\alpha$-$Fe_2O_3$ powder to TiC powder as shown in Table 1. The compositions and magnetic properties of these magnetic particles were measured in the same manner as in Reference Example 1. The results are shown in Table 1.

The magnetic particles of Reference Example 5, in which a mass ratio of $\alpha$-$Fe_2O_3$ powder to TiC powder was 4/6, had high corrosion resistance, saturation magnetization Ms of 48 $Am^2/kg$, lower than 50 $Am^2/kg$, and coercivity iHc of 18 kA/m, more than 15 kA/m. It is thus clear that the TiC content is preferably 30-50% by mass to keep high saturation magnetization without losing the properties of metal Fe particles.

TABLE 1

| No. | Mass Ratio of $Fe_2O_3$/TiC(1) | Mass Ratio of Fe/Ti(2) | Magnetic Properties Ms ($Am^2/kg$) | Magnetic Properties iHc (kA/m) |
|---|---|---|---|---|
| Reference Example 1 | 7/3 | 71/29 | 130 | 3.8 |
| Reference Example 2 | 6.5/3.5 | 66/34 | 116 | 6.2 |
| Reference Example 3 | 6/4 | 60/40 | 103 | 8.5 |
| Reference Example 4 | 5/5 | 47/53 | 75 | 13 |
| Reference Example 5 | 4/6 | 32/68 | 48 | 18 |

Note:
(1)A mass ratio of $\alpha$-$Fe_2O_3$ to TiC in the starting material (mixed powder).
(2)A mass ratio of Fe to Ti in the purified magnetic particles.

Reference Example 6

Coated, fine, magnetic metal particles were obtained in the same manner as in Reference Example 1 except that the heat treatment temperature was 800° C. The magnetic properties of this powder sample were measured in the same manner as in Reference Example 1. The C content in the powder sample was measured by a high-frequency-heated infrared absorption method using "EMIA-520" available from HORIBA, and the N content was measured by a heat conduction method in which heating was conducted in an inert gas, using "EMGA-1300" available from HORIBA. The results are shown in Table 2.

Reference Examples 7-11

Coated, fine, magnetic metal particles were obtained in the same manner as in Reference Example 6 except for substituting part of the TiC powder with TiN powder having a median diameter of 2.8 μm at the ratio shown in Table 2. The magnetic properties, C content and N content of these powder samples were evaluated in the same manner as in Reference Example 6. The results are shown in Table 2.

TABLE 2

| | Formulation of Starting Materials (% by mass) | | | TiN Content (% by mass) | Magnetic Properties | | Content (% by mass) | |
|---|---|---|---|---|---|---|---|---|
| No. | $Fe_2O_3$ | TiC | TiN | | Ms ($Am^2$/kg) | iHc (kA/m) | C | N |
| Reference Example 6 | 70 | 30 | 0 | 0 | 136 | 5.3 | 1.7 | 0.23 |
| Reference Example 7 | 70 | 27 | 3 | 10 | 140 | 5.2 | 1.4 | 0.17 |
| Reference Example 8 | 70 | 24 | 6 | 20 | 143 | 5.2 | 1.1 | 0.12 |
| Reference Example 9 | 70 | 21 | 9 | 30 | 151 | 4.7 | 0.9 | 0.09 |
| Reference Example 10 | 70 | 18 | 12 | 40 | 158 | 4.5 | 0.5 | 0.04 |
| Reference Example 11 | 70 | 15 | 15 | 50 | 106 | 1.6 | 0.2 | 0.04 |

As the amount of TiN increased, the contents of C and N decreased, and the saturation magnetization Ms was improved. Particularly when the TiN content was 20-40% by mass (Reference Examples 8 to 10), the C content was 1.3% by mass or less, and the N content was 0.2% by mass or less, their contents being extremely small. Reference Example 10 having a TiN content of 40% by mass exhibited Ms improved to 158 $Am^2$/kg. However, Reference Example 11 having a TiN content of 50% by mass had rather smaller Ms than that of Reference Example 6 containing no TiN, despite small contents of C and N. This appears to be due to the fact that a too small amount of C made a reduction reaction insufficient. However, the coated, fine, magnetic metal particles of Reference Example 11 had extremely small coercivity iHc, resulting in smaller residual magnetization and suppressed magnetic aggregation. Thus, it is suitable for applications needing redispersibility, such as magnetic beads, etc.

Reference Examples 12-17

Coated, magnetic metal particles were obtained in the same manner as in Reference Example 10 except for mixing starting materials for the period of time shown in Table 3 using a bead mill. The median diameter d50 of this magnetic powder was measured by a laser-diffraction particle size distribution meter ("LA-920" available from HOLIBA). The results are shown in Table 3. Table 3 also shows their magnetic properties and their C and N contents. The C content was measured in the same manner as in Reference Example 6, using "HFT-9" available from Kokusai Denshi Kogyo KK. The N content was measured by a Kjeldahl method comprising converting N contained in the sample to ammonia, and measuring ammonia by indophenol blue absorptiometry using a spectrophotometer ("UV-1600" available from Shimadzu Corporation). The contents of C and N in these Examples were lower than those shown in Table 2 as a whole; C being 0.24-0.54% by mass, and N being 0.01-0.02% by mass. The total content of C and N was 0.26% by mass at minimum in Reference Example 15, and 0.55% by mass at maximum in Reference Example 17.

TABLE 3

| | Mixing Time | Median Diameter | Magnetic Properties | | Content (% by mass) | |
|---|---|---|---|---|---|---|
| No. | (min) | (μm) | Ms ($Am^2$/kg) | iHc (kA/m) | C | N |
| Reference Example 12 | 90 | 2.0 | 130 | 1.7 | 0.29 | 0.01 |
| Reference Example 13 | 120 | 1.6 | 129 | 1.8 | 0.28 | 0.02 |
| Reference Example 14 | 150 | 1.1 | 128 | 1.9 | 0.27 | 0.02 |
| Reference Example 15 | 180 | 1.0 | 127 | 2.0 | 0.24 | 0.02 |
| Reference Example 16 | 210 | 0.86 | 125 | 2.2 | 0.33 | 0.02 |
| Reference Example 17 | 240 | 0.92 | 133 | 2.0 | 0.54 | 0.01 |

The powder samples of Reference Examples 6 and 8 to 10 were analyzed by X-ray photoelectron spectroscopy (XPS) using PHI-Quantera SXM available from ULVAC-PHI, Inc. Narrow spectra were measured with respect to 1 s-orbital electrons of O, 2p3-orbital electrons of Fe, and 2p-orbital electrons of Ti, to carry out quantitative analysis. The results are shown in Table 4.

TABLE 4

| | TiN Content | (atomic %) | | | Metal Fe/ |
|---|---|---|---|---|---|
| No. | (% by mass) | O | Fe | Ti | Total Fe (%) |
| Reference Example 6 | 0 | 72.4 | 13.1 | 14.5 | 4.3 |
| Reference Example 8 | 20 | 72.6 | 14.0 | 13.4 | 6.6 |
| Reference Example 9 | 30 | 73.1 | 13.3 | 13.6 | 6.5 |
| Reference Example 10 | 40 | 72.9 | 19.6 | 7.6 | 11.3 |

Increase in the TiN content resulted in the increase of the Fe content and the decrease of the Ti content. Namely, the addition of TiN increased the Fe content. This means that a Ti oxide layer became thinner. However, coating layers on the Fe core particles were not insufficient, because the percentage of Fe oxide did not increase as described later. It is considered that the magnetic properties were improved because the volume of a non-magnetic coating was kept minimum while fully coating Fe particles. Increase in the TiN content resulted in the decrease of the Fe oxide and the increase of the metal Fe. Particularly when the TiN content was 20-40% by mass, the percentage of metal Fe (metal Fe/total Fe) was 6% or more in any Reference Examples. This is due to the fact that the addition of TiN provided such a complete Ti oxide coating that metal Fe was not oxidized though the Ti oxide coating was thin.

Reference Examples 18-21

1 g of each powder sample obtained in Reference Examples 6 and 8-10 was added to 50 mL of an aqueous NaOH solution (concentration 1 M), to conduct an immersion treatment (alkali treatment) at 60° C. for 24 hours. After this alkali treatment, each powder sample was washed with water and dried. 25 mg of each powder sample was immersed in 1 mL of an aqueous solution of guanidine hydrochloride (concentration 6 M) at 25° C. for 24 hours (immersion test), and then the amount of Fe ions eluted was measured by an ICP analyzer ("SPS3100H" available from SII NanoTechnology Inc.). The results are shown in Table 5.

TABLE 5

| No. | Powder Sample Used | TiN Content (% by mass) | Amount of Fe Ions Eluted (mg/L) | |
|---|---|---|---|---|
| | | | Before Alkali Treatment | After Alkali Treatment |
| Reference Example 18 | Reference Example 6 | 0 | 200 | 21 |
| Reference Example 19 | Reference Example 8 | 20 | 170 | 16 |
| Reference Example 20 | Reference Example 9 | 30 | 150 | 14 |
| Reference Example 21 | Reference Example 10 | 40 | 7.2 | 6.2 |

The amount of Fe ions eluted was reduced to 50 mg/L or less by the alkali treatment. The larger the TiN content, the smaller the amount of Fe ions eluted. Particularly at the TiN content of 40% by mass, the amount of Fe ions eluted was as extremely small as less than 10 mg/L even before the alkali treatment, indicating excellent corrosion resistance.

With respect to the coated, fine metal particles of Reference Examples 12-17 shown in Table 3, the amount of Fe ions eluted was measured in the same manner as in Reference Example 18 without alkali treatment. The results are shown in Table 6. The amount of Fe ions eluted was 2.1 mg/L or less, indicating excellent corrosion resistance.

TABLE 6

| No. | Amount of Fe Ions Eluted (mg/L) |
|---|---|
| Reference Example 12 | 1.0 or less |
| Reference Example 13 | 1.0 or less |
| Reference Example 14 | 1.3 |
| Reference Example 15 | 1.6 |
| Reference Example 16 | 2.1 |
| Reference Example 17 | 1.1 |

The same X-ray diffraction measurement as in Reference Example 1 revealed that any powder samples obtained in Reference Examples 7-11 and 18-21 had half widths of 0.3° or less in the maximum peak of $TiO_2$, and intensity ratios (maximum peak of $TiO_2$/maximum peak of metal M) of 0.03 or more.

Reference Example 22

The coated, fine metal particles obtained in Reference Example 10 were coated with silica by a method described below. 5 g of the coated, fine metal particles were dispersed in 100 mL of ethanol, and 1 mL of tetraethoxysilane was added thereto. While stirring, the resultant dispersion was mixed with a mixture solution of 22 g of pure water and 4 g of ammonia water (25%), and stirred for 1 hour. After stirring, a supernatant liquid was removed with the magnetic particles held on an inner surface of the beaker by a magnet. After the magnetic particles thus obtained were subject to the above silica coating treatment twice, the solvent was substituted with isopropyl alcohol, and the magnetic particles were dried to obtain magnetic silica particles.

The performance of the magnetic silica particles as magnetic beads was evaluated by measuring the amount of DNA extracted from 100 μL of horse blood using a DNA extraction kit ("MagNA Pure LC DNA Isolation Kit I" available from Roche). DNA was extracted according to the protocol of the above Kit except for using a solution obtained by dispersing 12 mg of magnetic silica particles in 150 μL of isopropyl alcohol (IPA) as a liquid of magnetic beads. The amount of DNA in the resultant extract was measured by a UV spectrophotometer [photodiode array bio-spectrophotometer ("U-0080D" available from Hitachi High-Technologies Corporation)]. As a result, the amount of DNA extracted from 100 μL of horse blood was 2.7 μg.

Comparative Example 1

Using commercially available magnetic beads attached to MagNAPure LC DNA Isolation Kit I available from Roche, DNA was extracted in the same manner as in Reference Example 22. As a result, the amount of DNA extracted was 2.7 μg.

It is clear from the above that the coated, fine metal particles of Reference Example 22, which collect the same amount of DNA as that of the commercially available magnetic beads, are suitable as magnetic beads for extracting DNA.

Reference Example 23

Coated, fine metal particles were produced in the same manner as in Reference Example 10 except that the mixing time of starting material powders was 100 minutes, and provided with silica coatings in the same manner as in Reference Example 22 to obtain magnetic silica particles. The median diameter d50, specific surface area and magnetic properties of the magnetic silica particles are shown in Table 7. The specific surface area was measured by a BET method with nitrogen adsorption, using "Macsorb-1201" available from Mountech Co., Ltd.

Reference Example 24

Coated, fine metal particles were produced in the same manner as in Reference Example 6 except that the mixing time of starting material powders was 100 minutes, and provided with silica coatings in the same manner as in Reference Example 22 to obtain magnetic silica particles. The median diameter d50, specific surface area and magnetic properties of the magnetic silica particles were evaluated in the same manner as in Reference Example 23. The results are shown in Table 7.

Commercially available magnetic beads used in Comparative Example 1 were measured with respect to these properties. The results are shown in Table 7. The magnetic beads of Reference Examples 23 and 24 were smaller in particle size, higher (2 times or more) in saturation magnetization, and lower (about 1/10) in coercivity than those of Comparative Example 1.

TABLE 7

| No. | d50 (μm) | Specific Surface Area ($m^2/g$) | Ms ($Am^2/kg$) | iHc (kA/m) |
|---|---|---|---|---|
| Reference Example 23 | 7.6 | 2.3 | 112 | 1.6 |
| Reference Example 24 | 8.3 | 2.8 | 106 | 3.7 |
| Comparative Example 1 | 13 | 8.3 | 43.7 | 12 |

The magnetic beads used in each Example in Table 7 were evaluated with respect to the performance of extracting DNA from human whole blood. DNA was extracted from the whole blood in the same manner as in Reference Example 22, except that 100 μL of human whole blood was tested, and that the amount (mass) of magnetic silica particles used was changed as shown in Table 8. The amount of DNA in the extract was determined by labeling DNA with a fluorescent reagent intercalating into double-stranded DNA, and measuring its fluorescence intensity by the following method. Namely, 2 μL of a DNA extract liquid was mixed with 198 μL of a 200-times-diluted solution of a fluorescent reagent ("PicoGreen" available from Invitrogen) [diluted with a TE solution (10 mM of Tris-HCl and 1 mM of EDTA)], to react DNA with the fluorescent reagent, and its fluorescence intensity was measured by a fluorescence spectrophotometer ("F-4500" available from Hitachi Ltd.). Excited with light having a wavelength of 480 nm, the fluorescence intensity at a wavelength of 520 nm was measured. The amount of DNA extracted in each magnetic bead sample is shown in Table 8. The amount of DNA extracted per a unit surface area of each magnetic silica particle sample, which was calculated from the specific surface area shown in Table 7, is shown in Table 8.

Comparison on the same mass (12 mg) revealed that Reference Example 23 was as much as about 2.7 times Comparative Example 1 in the amount of DNA extracted per a unit area. Even when the amount of beads used was reduced to 2 mg (the amount of DNA extracted per a unit area was about 6 times as much as that when the amount of beads used was 12 mg), the amount of DNA extracted was stable at about 2 μg. Because the magnetic silica particles of Reference Example 23 had a smaller median diameter and a larger surface area effective for DNA extraction than those of Comparative Example 1, the former can extract DNA sufficiently even with a small amount of beads. Also, because of high saturation magnetization (see Table 7), the magnetic beads capturing DNA are magnetically collected with high efficiency, and suffer extremely small loss in a washing step, etc. Accordingly, the magnetic beads of Reference Example 23 are sufficiently higher than those of Comparative Example 1 in the amount of DNA extracted per a unit area. The magnetic silica particles of Reference Example 24 were slightly poorer than those of Reference Example 23, but exhibited higher DNA-extracting performance than that of Comparative Example 1.

TABLE 8

| No. | Mass of Beads (mg) | Amount of DNA Extracted (μg) | Amount of DNA Extracted Per Unit Area ($\mu g/m^2$) |
|---|---|---|---|
| Reference Example 23 | 2 | 2.15 | 0.47 |
| | | 1.90 | 0.41 |
| | 4 | 2.24 | 0.24 |
| | | 2.22 | 0.24 |
| | 6 | 2.58 | 0.19 |
| | | 2.40 | 0.17 |
| | 12 | 2.15 | 0.078 |
| | | 2.38 | 0.086 |
| | 24 | 2.18 | 0.040 |
| | | 2.14 | 0.039 |
| | 48 | 1.80 | 0.016 |
| | | 1.93 | 0.017 |
| Reference Example 24 | 2 | 0.98 | 0.17 |
| | | 1.04 | 0.19 |
| | 4 | 1.86 | 0.17 |
| | | 1.92 | 0.17 |
| | 6 | 2.07 | 0.12 |
| | | 2.67 | 0.16 |
| | 12 | 1.89 | 0.056 |
| | | 2.12 | 0.063 |
| | 24 | 2.35 | 0.035 |
| | | 1.87 | 0.028 |
| | 48 | 2.20 | 0.016 |
| | | 2.27 | 0.017 |
| Comparative Example 1 | 12 | 2.84 | 0.028 |
| | | 3.14 | 0.032 |

Reference Example 25

Figure 3:
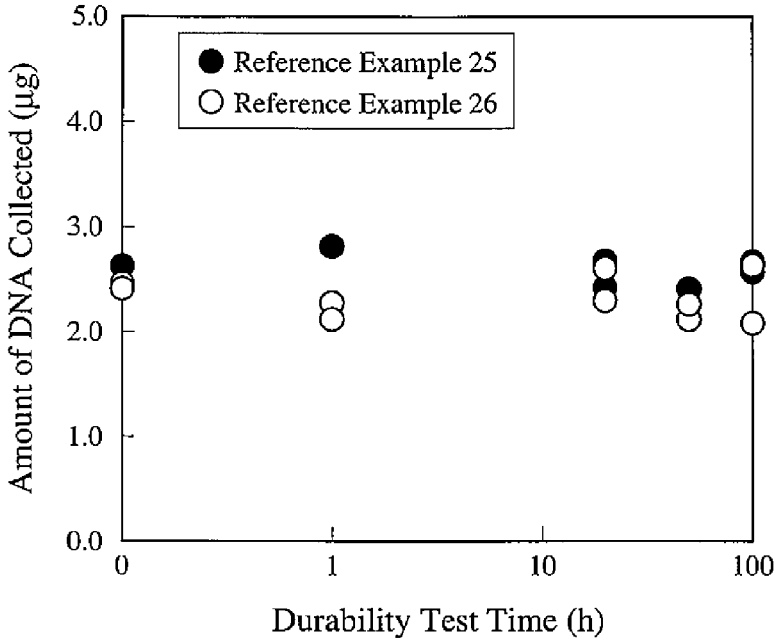
FIG. 3 is a graph showing the relation between the amount of DNA extracted and durability test time in Reference Examples 25 and 26.

The coated, fine metal particles obtained in Reference Example 17 were coated with silica to obtain magnetic silica particles in the same manner as in Reference Example 22. To evaluate the performance stability of the magnetic silica particles as magnetic beads, a durability test described below was conducted, and the DNA-extracting performance of the magnetic silica particles was evaluated after the test. The durability test was conducted by charging 0.32 g of magnetic silica particles and 4 mL of isopropyl alcohol (IPA) into a screw-cap bottle having a volume of 6 mL, and keeping it at 60° C. for 1 hour, 10 hours, 50 hours and 100 hours, respectively. Because magnetic beads are usually stored at room temperature or in a cool state, keeping their temperature at 60° C. causes forced deterioration for durability evaluation. Using the magnetic beads after the durability test, DNA was extracted from 100 μL of horse blood in the same manner as in Reference Example 16. FIG. 3 shows the relation between the amount of DNA extracted and the durability test time.

Reference Example 26

The coated, fine metal particles obtained in Reference Example 17 were coated with silica to obtain magnetic silica particles in the same manner as in Reference Example 22, except for adding 0.05 g of aluminum isopropoxide (corresponding to 5% by mass of tetraethoxysilane) together with 1 mL of tetraethoxysilane. The magnetic silica particles were subject to the same durability test as in Reference Example 25, and their DNA-extracting performance after the durability test was evaluated to examine the stability of performance as magnetic beads. The results are shown in FIG. 3.

The amount of DNA collected was stable in both Reference Examples 25 and 26, resulting in substantially no change in the amount of DNA collected even after 100 hours of immersion in IPA (24-times-accelerated test relative to storing at room temperature). Namely, the magnetic silica particles of Reference Examples 25 and 26 had excellent durability of DNA-extracting performance. This means that the coated, fine metal particles were neither modified nor deteriorated even by heating at 60° C. in IPA because of excellent corrosion resistance as shown in Table 3. Namely, these magnetic silica particles exhibit stable DNA-extracting performance, and excellent long-term stability of performance as magnetic beads.

Reference Example 27

Coated, fine, magnetic metal particles were produced in the same manner as in Reference Example 10 except for using a bead mill when blending the starting materials. Measurement by a laser-diffraction particle size distribution meter ("LA-920" available from HORIBA) revealed that this powder sample had a particle size of 0.8 μm.

Comparative Example A

Silica coating was conducted to obtain magnetic silica particles in the same manner as in Reference Example 22 except for using the coated, fine metal particles obtained in Reference Example 27.

Reference Example 28

The coated, fine metal particles of Reference Example 27 were coated with silica in the same manner as in Reference Example 22 to obtain magnetic silica particles were produced. 0.1 g of the magnetic silica particles and 2 mL of an aqueous solution of 3-aminopropyltriethoxysilane (APS) were mixed and stirred for 1 hour, and dried in the air to obtain amino-group-fixed magnetic beads (amino-group-coated magnetic beads). Using BioMag Plus Amine Particle Protein Coupling Kit available from Bang Laboratories, streptavidin was fixed to the amino-group-coated magnetic beads by the following procedure. First, 15 mg of the amino-group-coated magnetic beads and 600 μL of glutaraldehyde adjusted to 5% by a pyridine wash buffer (PWB) attached to the kit were mixed, and stirred at room temperature for 3 hours. Non-magnetic components were removed from the resultant dispersion by magnetic separation, and the magnetic beads were washed with PWB 4 times. The resultant dispersion of magnetic beads in PWB was mixed with streptavidin (available from Wako Pure Chemical Industries, Ltd.), and stirred at 4° C. for 16 hours. 600 μL of a quenching solution attached to the kit was added to the dispersion, and stirred at room temperature for 30 minutes. By magnetic separation to remove non-magnetic components and washing with PWB 4 times, streptavidin-fixed, coated, fine metal particles (streptavidin-coated magnetic beads) were obtained.

Reference Example 29

Amino-group-coated magnetic beads produced by the same method as in Reference Example 28 were coated with a carboxyl group using succinic anhydride, and then activated with carbodiimide to fix streptavidin to the magnetic beads to obtain streptavidin-coated magnetic beads.

After the coated, fine metal particles obtained in Comparative Example A and Reference Examples 28 and 29 were stained with biotinylated fluorescein isothiocyanate (FITC) available from Molecular Probes, the amount of streptavidin fixed was measured by flow cytometry using a flow cytometer EPICS ALTRA® available from Beckman Coulter, Inc. The results are shown in FIG. 4.

The flow cytometer is an apparatus for measuring fluorescence intensity of each particle. The fact that a histogram obtained by the measurement of large numbers of particles is shifted toward higher fluorescence intensity indicates that more fluorescent materials existed on the particle surfaces. It is also known that biotin tends to bond to streptavidin, forming a biotin-avidin bond. The fact that a histogram obtained by the measurement by a flow cytometer of streptavidin-fixed magnetic beads reacted with biotinylated FITC is shifted toward higher intensity of FITC fluorescence indicates that a larger amount of streptavidin is fixed to the particle surfaces.

Figure 4:
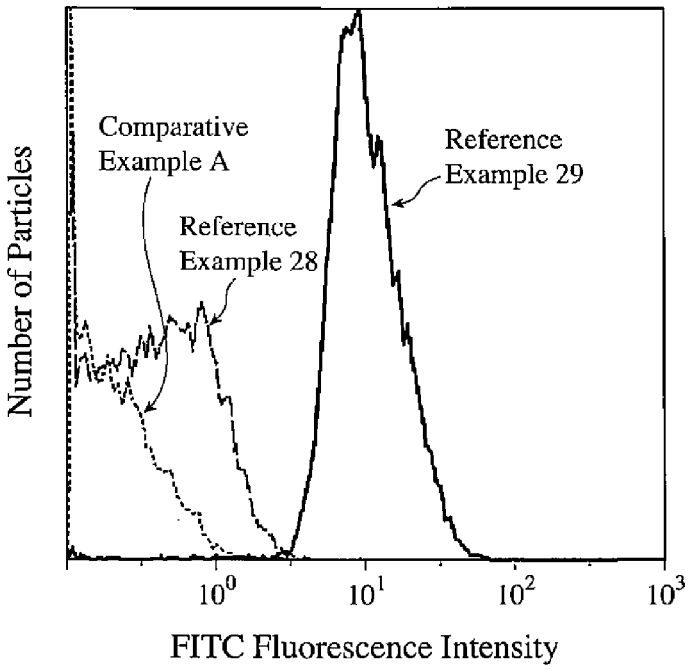
FIG. 4 is a graph showing the relation between FITC fluorescence intensity and the number of particles when measured by a flow cytometer in Reference Examples 28 and 29 and Comparative Example A.

As is clear from FIG. 4, the streptavidin-coated magnetic beads of Reference Examples 28 and 29 had higher intensity of FITC fluorescence than that of the coated, fine metal particles of Comparative Example A onto which streptavidin was not fixed, indicating that streptavidin was fixed to the former.

Reference Example 30

Figure 5:
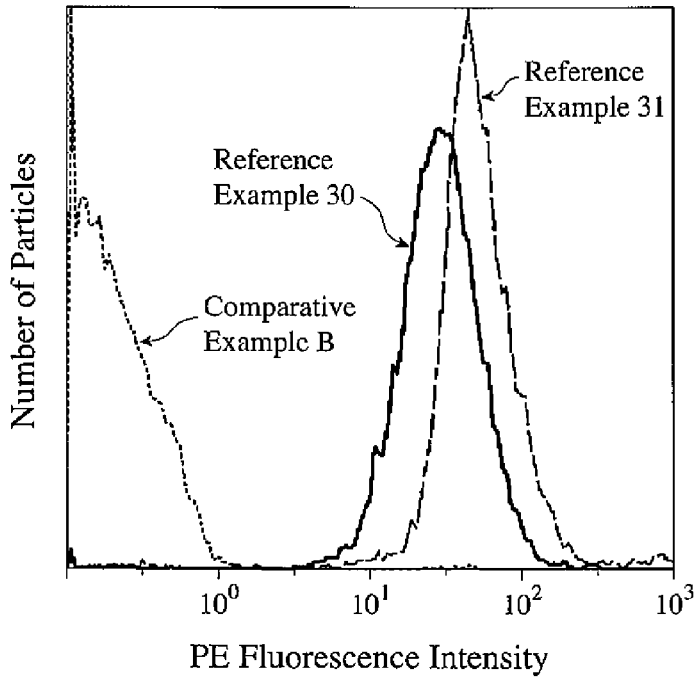
FIG. 5 is a graph showing the relation between FITC fluorescence intensity and the number of particles when measured by a flow cytometer in Reference Examples 30 and 31, and Comparative Example B.

The streptavidin-coated magnetic beads of Reference Example 28 were reacted with biotinylated antibody (Epithelial Specific Antigen-Biotin Labeled, Affinity Pure available from Biomeda) to obtain antibody-fixed, coated, fine metal particles (antibody-fixed magnetic beads). The antibody-fixed magnetic beads were stained with secondary antibody [PE-labeled, Goat $F(ab')_2$ Anti Mouse IgG (H+L) available from Beckman Coulter], and measured by flow cytometry. The results are shown in FIG. 5.

Reference Example 31

Antibody (VU-1D9)-fixed, coated, fine metal particles (antibody-fixed magnetic beads) were obtained in the same manner as in Reference Example 29 except for using the antibody of VU-1D9 in place of streptavidin. The antibody-fixed magnetic beads were stained with secondary antibody [PE-labeled, Goat $F(ab')_2$ Anti Mouse IgG (H+L) available from Beckman Coulter], and measured by flow cytometry. The results are shown in FIG. 5.

The secondary antibody is selectively bonded to the antibody. The fact that a histogram obtained by the measurement by a flow cytometer of antibody-fixed magnetic beads reacted with PE secondary antibody is shifted toward higher intensity of PE fluorescence indicates that a larger amount of antibody is fixed to the particle surfaces.

As is clear from FIG. 5, the antibody-fixed magnetic beads of Reference Examples 30 and 31 had higher intensity of PE fluorescence than that of the coated, fine metal particles of Reference Example 28 (Comparative Example B), onto which the antibody was not fixed, indicating that the antibody was fixed to the former.

Reference Example 32

Coated, fine metal particles, onto which mouse IgG antibody was fixed, were produced in the same manner as in Reference Example 29 except for using mouse IgG antibody in place of streptavidin, and immersed in a solution of a blocking agent ("Block Ace" available from Snow Brand Milk Products Co., Ltd.) overnight to obtain blocking-agent-coated magnetic beads. Reference Example 32A stained with secondary antibody [PE-labeled, Goat F(ab')2 Anti Mouse IgG (H+L) available from Beckman Coulter] specifically reacting with the fixed mouse IgG antibody, Reference Example 32B stained with secondary antibody [PE-labeled, Goat $F(ab')_2$ Anti Mouse IgM available from Beckman Coulter] not specifically reacting with the fixed antibody, and Reference Example 32 (Comparative Example C) not stained with the secondary antibody were measured by flow cytometry. The results are shown in FIG. 6.

Figure 6:
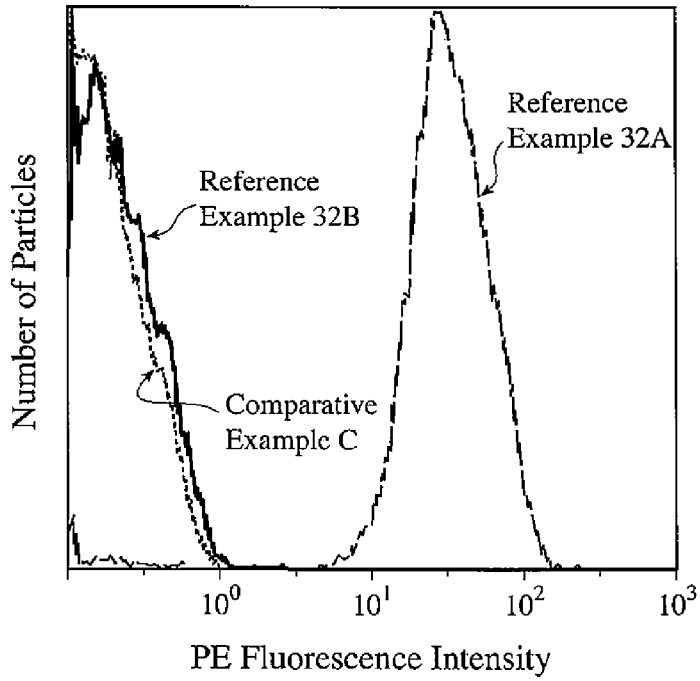
FIG. 6 is a graph showing the relation between PE fluorescence intensity and the number of particles when measured by a flow cytometer in Reference Examples 32A and 32B, and Comparative Example C.

As is clear from FIG. 6, the blocking-agent-coated magnetic beads of Reference Example 32 reacted only with the specifically reactable secondary antibody. It was thus found that nonspecific adsorption did not occur.

Reference Example 35

Figure 7:
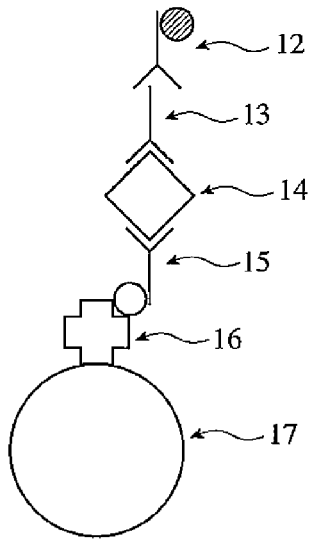
FIG. 7 is a schematic view showing ELISA produced by the coated, fine metal particles.

As shown in FIG. 7, the coated, fine metal particles 17 produced in Reference Example 29, onto which streptavidin 16 was fixed, were incubated with biotin-labeled, anti-human adiponectin antibody (mouse) 15 ("Biotin-Labeled, Anti-Human Adiponectin/Acrp30 Antibody" available from R&D SYSTEMS) for 30 minutes to obtain the coated, fine metal particles 17, onto which the antibody 15 was fixed. Using the coated, fine metal particles 17, sandwich ELISA (enzyme-linked immunosorbent assay) was conducted. First, the coated, fine metal particles 17 onto which the antibody 15 was fixed and the human adiponectin 14 ("Human Adiponectin, His-Tagged Fusion Protein" available from BioVendor) were incubated. After the coated, fine metal particles 17 were incubated with anti-human adiponectin antibody (rabbit) (first antibody liquid) 13 attached to the Human Adiponectin ELISA Kit (Otsuka Pharmaceutical Co., Ltd.) and washed, they were incubated with horseradish peroxidase (HRP)-labeled, rabbit IgG polyclonal antibody (goat) (enzyme-labeled antibody solution) 12 and washed. After reaction with a substrate, the reaction was terminated with a reaction termination liquid to measure signal intensity (absorbance at 450 nm) by a UV spectrometer. The same operation was conducted with the concentration of the human adiponectin 14 changed, to obtain the relation between the concentration of the human adiponectin 14 and signal intensity. The results are shown in FIG. 8.

Figure 8:
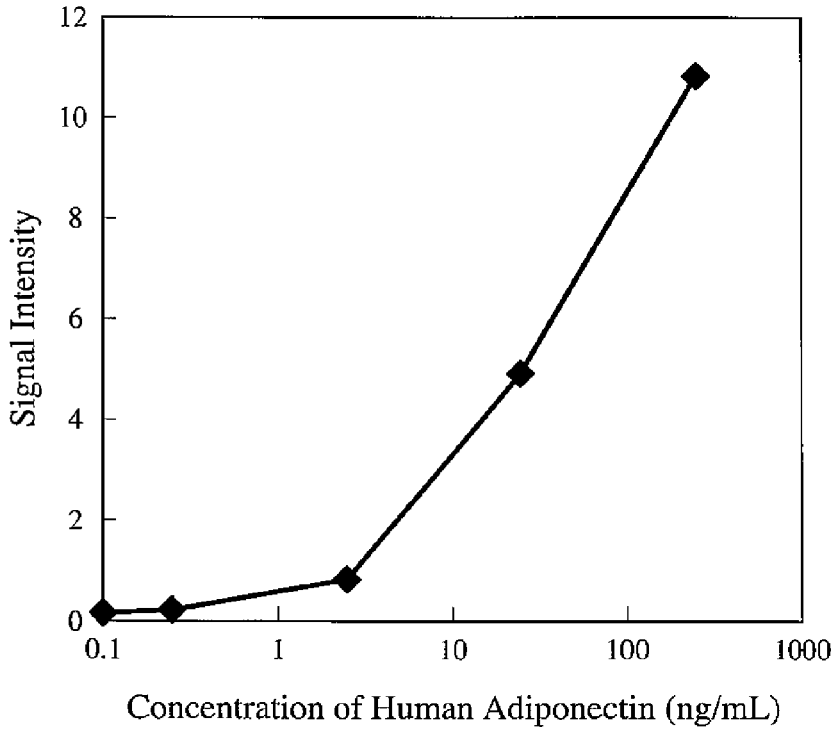
FIG. 8 is a graph showing the relation between the concentration of human adiponectin and the signal intensity in Reference Example 35.

As is clear from FIG. 8, there was a correlation between the concentration of human adiponectin and the signal intensity. After calibration is prepared using a human adiponectin solution having a known concentration, a human adiponectin solution having an unknown concentration can be measured to determine the concentration of human adiponectin from the measured signal intensity. It has thus been found that the coated, fine metal particles are suitable for immunoassay.

Reference Example 36

Coated, fine metal particles, onto which biotin-labeled, anti-human adiponectin antibody (mouse) was fixed, were produced in the same manner as in Reference Example 35, except for using the magnetic silica particles of Reference Example 26. Using the above coated, fine metal particles, sandwich ELISA (enzyme-linked immunosorbent assay) was conducted in the same manner as in Reference Example 35. The results are shown in FIG. 9.

Reference Example 37

Coated, fine metal particles, onto which biotin-labeled, anti-human adiponectin antibody (mouse) was fixed, were produced in the same manner as in Reference Example 35 except for using the magnetic silica particles of Reference Example 25. Using the above coated, fine metal particles, sandwich ELISA (enzyme-linked immunosorbent assay) was conducted in the same manner as in Reference Example 35. The results are shown in FIG. 9.

Figure 9:
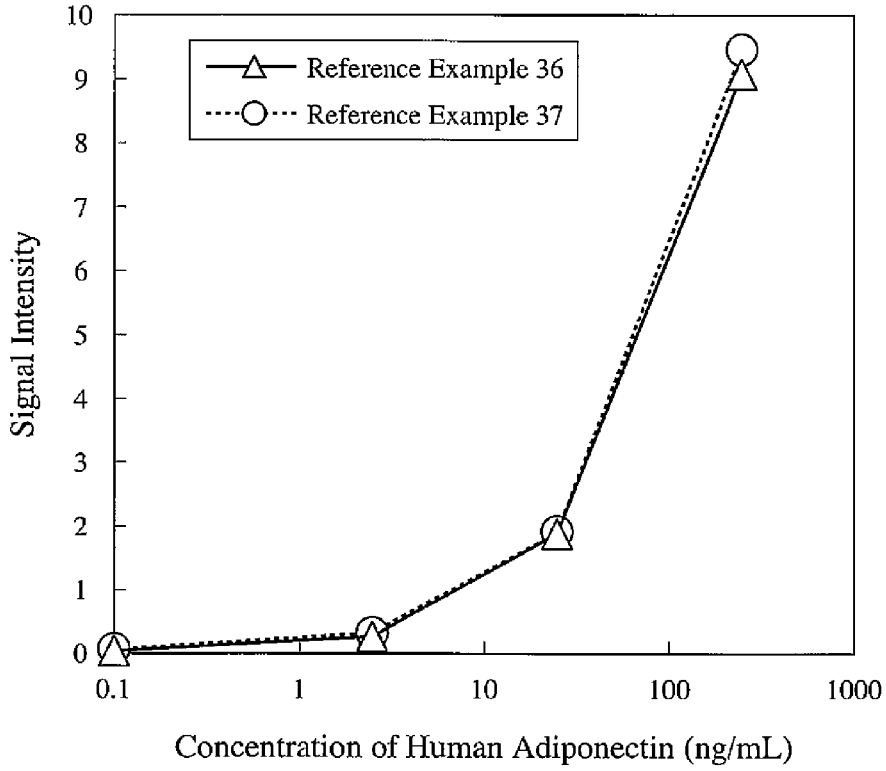
FIG. 9 is a graph showing the relation between the concentration of human adiponectin and the signal intensity in Reference Examples 36 and 37.

As is clear from FIG. 9, there was a correlation between the concentration of human adiponectin and the signal intensity, indicating that these coated, fine metal particles are suitable for immunoassay.

Reference Example 38

The coated, fine metal particles of Reference Example 17 were coated with silica by the following method. 5 g of the coated, fine metal particles were dispersed in 100 mL of ethanol, and 1 mL of tetraethoxysilane and 0.05 g of aluminum isopropoxide were added thereto. A mixture solution of 22 g of pure water and 4 g of ammonia water (25%) was added to the dispersion while stirring, and stirring was continued for 1 hour. After stirring, a supernatant liquid was removed with magnetic particles held on an inner surface of a beaker by a magnet. After the magnetic particles were further subject to the above silica coating treatment twice, the solvent was replaced by isopropyl alcohol, and the magnetic silica particles were dried. The magnetic silica particles had a median diameter d50 of 0.8 μm and a variation coefficient of 47%. The median diameter d50 and the variation coefficient were measured by a laser-diffraction particle size distribution meter ("LA-920" available from HORIBA).

Example 1

30 g of magnetic silica particles obtained in Reference Example 38 were mixed with 500 mL of isopropyl alcohol (IPA) and dispersed under ultrasonic irradiation for 30 minutes. After the resultant dispersion was subject to spontaneous sedimentation over 24 hours, a supernatant liquid was removed to collect magnetic particles by magnetic separation. The magnetic particles had a median diameter d50 of 0.5 μm and a variation coefficient of 27%.

Example 2

1 g of the magnetic silica particles of Reference Example 38 were mixed with 50 mL of isopropyl alcohol (IPA), dispersed in the same manner as in Example 1, and subject to centrifugal separation at 3000 rpm for 120 seconds to precipitate coarse particles, and magnetic particles were removed from a supernatant liquid by magnetic separation. The magnetic particles had a median diameter d50 of 0.5 μm and a variation coefficient of 26%.

Example 3

0.1 g of the magnetic silica particles of Reference Example 38 were mixed with 100 mL of IPA, and dispersed in the same manner as in Example 1. Using a filter paper having a pore diameter of 1 μm (GF/B available from Whatman), the dispersion was filtered under suction to magnetically separate magnetic particles from a filtrate. The magnetic particles had a median diameter d50 of 0.6 μm and a variation coefficient of 28%.

The magnetic properties of fine particles obtained in Examples 1-3 are shown in Table 9. The magnetic properties were measured by VSM in the same manner as in Reference Example 1. Any fine particles had saturation magnetization of 80 $Am^2/kg$ or more, and even fine particles of 0.5-0.6 μm had high magnetization per one particle.

TABLE 9

| No. | d50 (μm) | Variation Coefficient (%) | Saturation Magnetization Ms ($Am^2/kg$) | Coercivity (kA/m) |
|---|---|---|---|---|
| Reference Example 38 | 0.8 | 47 | 121 | 1.7 |
| Example 1 | 0.5 | 27 | 82 | 1.6 |
| Example 2 | 0.5 | 26 | 81 | 1.8 |
| Example 3 | 0.6 | 28 | 85 | 1.6 |

Example 4

Figure 10:
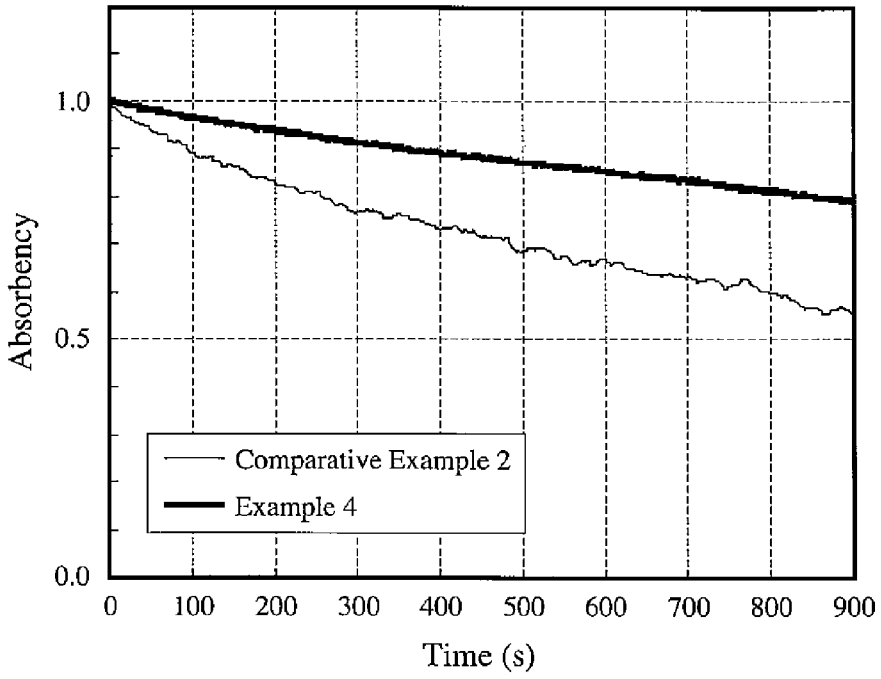
FIG. 10 is a graph showing the absorbency changes of the dispersions of coated, fine metal particles of Example 4 and Comparative Example 2 with the time.

Streptavidin was fixed to surfaces of the magnetic silica fine particles of Example 1 in the same manner as in Reference Example 29. The magnetic particles had a median diameter d50 of 0.5 μm and a variation coefficient of 27%. The streptavidin-coated magnetic beads were dispersed in a PBS buffer at a particle concentration of 0.25 mg/mL under ultrasonic irradiation for 1 minute. 1 mL of this dispersion was measured with respect to absorbency change at wavelength of 550 nm for 900 seconds by a UV spectrophotometer (photodiode array bio-spectrophotometer U-0080D available from Hitachi High-Technologies Corporation), to determine the sedimentation speed of the magnetic beads. The results are shown in FIG. 10. Linear approximation revealed that the change of absorbency with time was $-0.0001\ s^{-1}$. Namely, the absorbency decrease ratio per one second was 0.01%.

Comparative Example 2

Streptavidin was fixed to surfaces of the magnetic silica particles of Reference Example 38 in the same manner as in Reference Example 29. The magnetic particles had a median diameter d50 of 0.8 μm and a variation coefficient of 47%. The sedimentation speed of the streptavidin-coated magnetic beads was measured in the same manner as in Example 4. The results are shown in FIG. 10. The absorbency decrease ratio determined as in Example was 0.04%.

The magnetic silica particles of Example 4 had a lower sedimentation speed in a solution because of smaller particle sizes than those of Comparative Example 2. Accordingly, when used for immunoassay, the magnetic beads can sufficiently react with a target material floating in a solution, resulting in high detection sensitivity.

Comparative Example 3

Coated, fine metal particles were produced in the same manner as in Reference Example 1 except for changing the mixing time to 200 minutes, and provided with a silica coating in the same manner as in Reference Example 22 to obtain magnetic silica particles having an average particle size of 4.1 μm and a variation coefficient of 56%. Streptavidin was fixed to the magnetic silica particles in the same manner as in Reference Example 29.

Comparative Example 4

Coated, fine metal particles was produced in the same manner as in Reference Example 1 except for changing the mixing time to 100 minutes, and provided with a silica coating in the same manner as in Reference Example 22 to obtain magnetic silica particles having an average particle size of 6.7 μm and a variation coefficient of 44%. Streptavidin was fixed to the magnetic silica particles in the same manner as in Reference Example 29.

Figure 11:
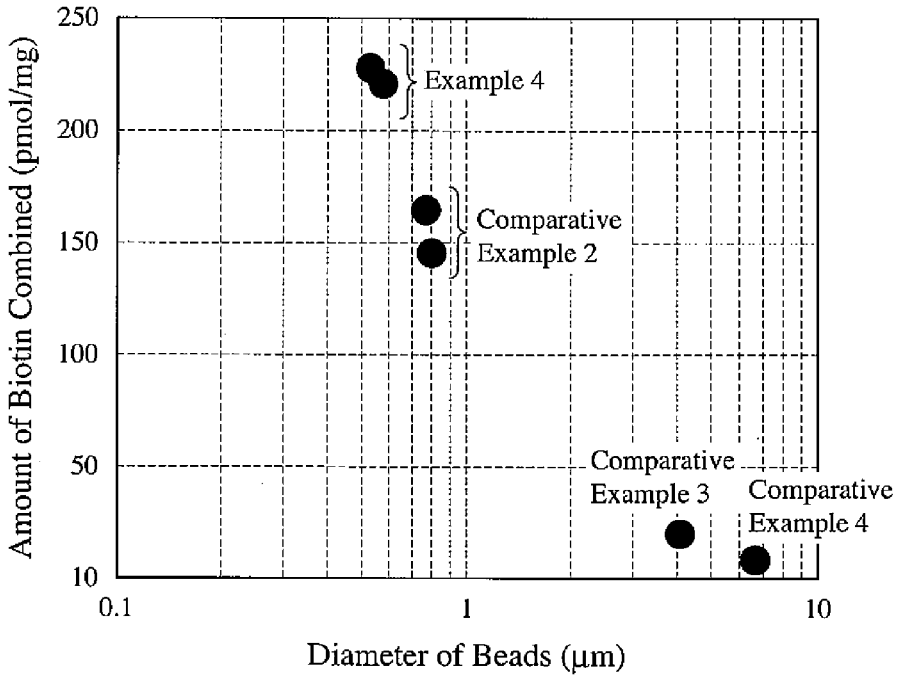
FIG. 11 is a graph showing the relation between the median diameter of magnetic beads and the amount of biotin combined in Example 4 and Comparative Examples 2-4.

Using the magnetic beads of Example 4 and Comparative Examples 2-4 (n=2 in Example 4 and Comparative Example 2), the amount of biotin combined per 1 mg was measured by the following method. The results are shown in FIG. 11. A large amount of streptavidin was fixed in Example 4 because of small particle sizes, so that the amount of biotin combined was as high as 200 pmol or more. This revealed that fine magnetic beads can detect target materials at higher sensitivity in immune reactions.

Method for Measuring Amount of Biotin Combined

A 0.3-mM solution of biotin-4-fluorescein (B10570 available from Invitrogen) in dimethyl sulfoxide was diluted to 15 μM with Buffer A-T (100 mM of NaCl, 50 mM of $NaH_2PO_4$, 1 mM of ethylenediaminetetraacetic acid, and 0.1% of Tween 20), to prepare a work liquid. 0.1 mg of the magnetic beads were dispensed in 600-μl microtubes, and 200 μl of pure water was added to each microtube. Bead particles were dispersed under ultrasonic irradiation for 10 seconds. After removing a supernatant liquid by magnetic separation, the particles were washed with Buffer A-T once, and stirred with 300 μl of Buffer A-T added again. 100 μl of this suspension of beads was mixed with 8 μl of the above work liquid, and Buffer A-T was added such that the total amount of the solution became 400 μl. This suspension was stirred at room temperature for 1 hour with light shut, and unreacted biotin-4-fluorescein remaining in the magnetically separated supernatant liquid was quantitatively determined by measuring fluorescence intensity at 525 nm when irradiated with exciting light at 490 nm, using a fluorescence spectrophotometer (F-4500 available from Hitachi, Ltd.). The amount of biotin combined to the magnetic beads was determined from the amount of the unreacted biotin-4-fluorescein remaining in the supernatant liquid.

Comparative Example 5

Coated, fine, magnetic metal particles produced in the same manner as in Reference Example 17 except for changing the heat treatment time to 8 hours was coated with silica in the same manner as in Reference Example 38 to produce silica-coated, fine particles.

Examples 5 and 6

Silica-coated, fine particles were produced in the same manner as in Comparative Example 5, except that the formulations of TiC and TiN were changed as shown in Table 10, and that starting materials were mixed in a ball mill for 72 hours.

The magnetic properties, etc. of the silica-coated, fine particles of Examples 5 and 6 and Comparative Example 5 are shown in Table 10.

TABLE 10

| | Formulation of Starting Materials (% by mass) | | | d50 | Variation Coefficient | Saturation Magnetization | Coercivity |
|---|---|---|---|---|---|---|---|
| No. | $Fe_2O_3$ | TiC | TiN | (μm) | (%) | Ms ($Am^2/kg$) | (kA/m) |
| Comparative Example 5 | 70 | 18 | 12 | 0.7 | 44 | 111 | 1.7 |
| Example 5 | 60 | 24 | 16 | 0.7 | 35 | 134 | 1.9 |
| Example 6 | 50 | 30 | 20 | 0.7 | 29 | 125 | 2.6 |

Examples 7 and 8 and Comparative Example 6

Streptavidin was fixed to surfaces of the silica-coated, fine particles of Examples 5 and 6 and Comparative Example 5 in the same manner as in Reference Example 29, to obtain streptavidin-fixed, magnetic beads of Examples 7 and 8 and Comparative Example 6. The median diameters d50 and variation coefficients of the streptavidin-fixed, magnetic beads are shown in Table 11.

TABLE 11

| No. | d50 (μm) | Variation Coefficient (%) |
|---|---|---|
| Comparative Example 6 | 0.7 | 44 |
| Example 7 | 0.7 | 35 |
| Example 8 | 0.7 | 29 |

Figure 12:
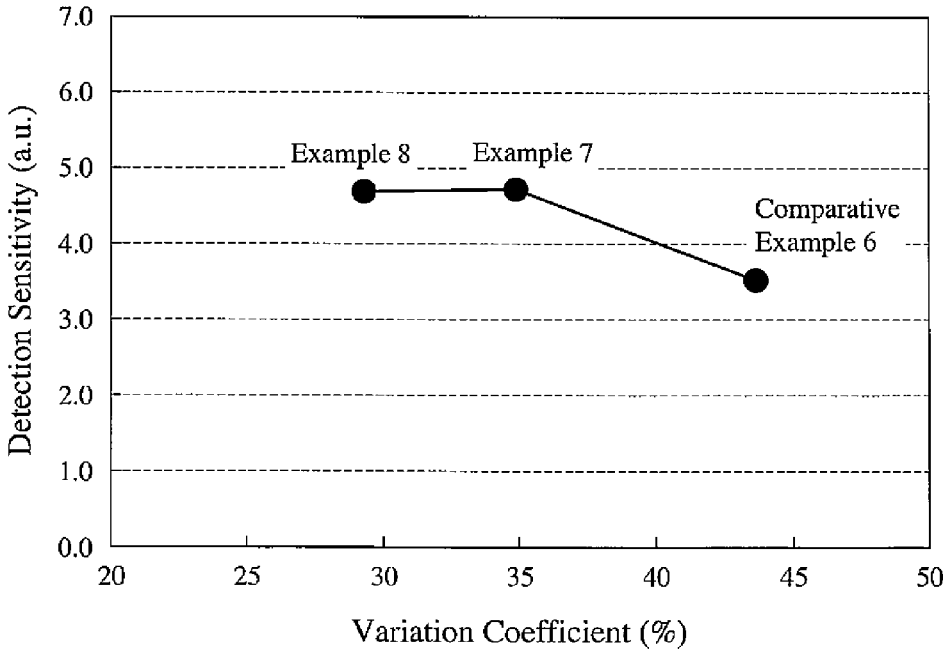
FIG. 12 is a graph showing the relation between the detection sensitivity and the particle size variation coefficient of magnetic beads.

Using these streptavidin-fixed, magnetic beads, sandwich ELISA (enzyme-linked immunosorbent assay) described in Reference Example 35 was conducted. With the concentration of human adiponectin (Human Adiponectin, His-Tagged Fusion Protein available from BioVendor) fixed to 250 ng/mL, these samples with different variation coefficients were compared with respect to signal detection sensitivity. The dependency of the detection sensitivity on the variation coefficient is shown in FIG. 12. The detection sensitivity increased as the variation coefficient decreased, and was saturated at 35% or less.

EFFECT OF THE INVENTION

The method of the present invention can produce coated, fine metal particles having excellent corrosion resistance as well as excellent target-material-collecting capability easily at low cost. The coated, fine metal particles of the present invention each having a Ti oxide coating and a silicon oxide coating formed in this order on a metal particle have such high corrosion resistance that they can be used in a corrosive solution. Because of small particle sizes and narrower particle size distributions, their sedimentation speed is slow, making it possible to collect target materials in a solution sufficiently. Accordingly, they are suitable for the extraction of DNA, the detection of antigens fixed to antibodies, etc.

What is claimed is:

1. A method for producing coated, fine metal particles each having a Ti oxide coating and a silicon oxide coating formed in this order on a metal core particle comprising the steps of mixing powder comprising TiC and TiN with oxide powder of a metal M meeting the relation of $\Delta G_{M\text{-}O} > \Delta G_{TiO2}$, wherein $\Delta G_{M\text{-}O}$ represents the standard free energy of forming an oxide of the metal M; heat-treating the resultant mixed powder in a non-oxidizing atmosphere to reduce said oxide of the metal M with said powder comprising TiC and TiN, while coating the resultant metal M particles with Ti oxide; coating the Ti-oxide-coated surface with silicon oxide; and classifying the resultant particles such that they have a median diameter d50 of 0.4-0.7 μm, and a variation coefficient (=standard deviation/average particle size) of 35% or less, which indicates a particle size distribution range.

2. The method for producing coated, fine metal particles according to claim 1, wherein said classification is conducted by a magnetic separation method, a decantation method, a filtration method, a centrifugal separation method, or a combination thereof.

3. The method for producing coated, fine metal particles according to claim 1, wherein said powder comprising TiC and TiN contains 10-50% by mass of TiN.

4. The method for producing coated, fine metal particles according to claim 1, wherein said Ti oxide is based on $TiO_2$.

5. The method for producing coated, fine metal particles according to claim 1, wherein said heat treatment is conducted at 650-900° C.

6. Fine, coated metal particles each having a Ti oxide coating and a silicon oxide coating formed in this order on a metal core particle, which have a median diameter d50 of 0.4-0.7 μm, and a variation coefficient (=standard deviation/average particle size) of 35% or less, which indicates a particle size distribution range.

7. The coated, fine metal particles according to claim 6, wherein the carbon content is 0.2-1.4% by mass, and the nitrogen content is 0.01-0.2% by mass.

8. The coated, fine metal particles according to claim 7, wherein the total amount of carbon and nitrogen is 0.24-0.6% by mass.

9. The coated, fine metal particles according to claim 6, which has saturation magnetization of 80 $Am^2/kg$ or more.

10. The coated, fine metal particles according to claim 6, wherein when the absorbency of a dispersion of the coated, fine metal particles in a PBS buffer is measured in a still state, a decreasing speed of the absorbency is 0.01-0.03% per one second.

11. The coated, fine metal particles according to claim 6, which are used for the detection of an antigen in immunoassay.

12. The coated, fine metal particles according to claim 6, wherein two or more metal M particles are included in said Ti oxide coating.

13. The coated, fine metal particles according to claim 6, wherein the half width of the maximum peak of $TiO_2$ is 0.3° or less, and the intensity ratio of the maximum peak of $TiO_2$ to the maximum peak of the metal M is 0.03 or more.

* * * * *